US011028977B2

(12) United States Patent
Van Bommel et al.

(10) Patent No.: US 11,028,977 B2
(45) Date of Patent: Jun. 8, 2021

(54) LIGHT EMITTING MODULE

(71) Applicant: SIGNIFY HOLDING B.V., Eindhoven (NL)

(72) Inventors: Ties Van Bommel, Horst (NL); Robert Jacob Pet, Waalre (NL); Alexander Henricus Walterus Van Eeuwijk, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/632,365

(22) PCT Filed: Jul. 17, 2018

(86) PCT No.: PCT/EP2018/069412
§ 371 (c)(1),
(2) Date: Jan. 19, 2020

(87) PCT Pub. No.: WO2019/016217
PCT Pub. Date: Jan. 24, 2019

(65) Prior Publication Data

US 2020/0224832 A1 Jul. 16, 2020

(30) Foreign Application Priority Data

Jul. 21, 2017 (EP) ..... 17182652

(51) Int. Cl.
*F21K 9/62* (2016.01)
*F21K 9/68* (2016.01)
(Continued)

(52) U.S. Cl.
CPC ..... *F21K 9/62* (2016.08); *F21K 9/68* (2016.08); *F21Y 2103/33* (2016.08); *F21Y 2105/00* (2013.01); *F21Y 2115/10* (2016.08)

(58) Field of Classification Search
CPC ..... F21K 9/62
See application file for complete search history.

(56) References Cited

U.S. PATENT DOCUMENTS 4,868,725 A * 9/1989 Sakagawa ..... F21S 43/255 362/231
9,230,943 B2 1/2016 Harbers et al.
(Continued)

FOREIGN PATENT DOCUMENTS

CN 104968991 A 10/2015
EP 1826474 A1 8/2007
(Continued)

*Primary Examiner* — Sean P Gramling
(74) *Attorney, Agent, or Firm* — Daniel J. Piotrowski

(57) ABSTRACT

The invention provides a light emitting module (100) which comprises a light mixing chamber (101). The light mixing chamber comprises a base (102), at least one partly light transmissive side wall (103), an at least partly light transmissive-semi-reflective light exit window (104), a carrier (107), and at least one light emitting diode (105). The base (102) has a reflective inner surface (114). The at least one partly light transmissive side wall (103) extends from the base (102) towards the at least partly light transmissive,
(Continued)

semi-reflective light exit window (104) which is arranged opposite to the base (102). The carrier (107) carries at least one light emitting diode (105) and is positioned at a distance (D1) from a nearest portion (108) of the at least one partly light transmissive side wall (103). The at least one light emitting diode (105) is arranged to emit source light (106) in a main direction different from 90 degrees with respect to the semi-reflective light exit window (104) and in the main direction away from the nearest portion (108) of the at least one partly light transmissive side wall (103) to enable subsequent mixing of the source light (106) within the mixing chamber (101) to generate mixed light (106'). The semi-reflective light exit window (104) and the at least one partly light transmissive side wall (103) are arranged to couple out source light (106) and mixed light (106') as emitted light (106"). The mixing chamber has an inner mixing chamber width (W1) in the direction along the base (102) between the nearest portion (108) of the at least one partly light transmissive side wall (103) and an opposite portion (109) of the at least one partly light transmissive side wall (103) which is positioned opposite to the nearest portion (108) of the at least one partly light transmissive side wall (103). An inner mixing chamber height (H1) spaces the base (102) and the semi-reflective light exit window (104). The inner mixing chamber width (W1) and the inner mixing chamber height (H1) have an aspect ratio in the range of 4 to 15. The semi-reflective light exit window (104) has a reflectivity in the range from 30 to 80% for source light (106) and mixed light (106'). The distance (D1) from the at least one light emitting diode (105) to the nearest portion (108) of the at least one partly light transmissive side wall (103) is in the range from 5 to 30% of the inner mixing chamber width (W1).

15 Claims, 4 Drawing Sheets

(51) Int. Cl.

| | |
|---|---|
| *F21Y 103/33* | (2016.01) |
| *F21Y 115/10* | (2016.01) |
| *F21Y 105/00* | (2016.01) |

(56) References Cited

U.S. PATENT DOCUMENTS

| | | | | |
|---|---|---|---|---|
| 2009/0109669 | A1 | 4/2009 | Rains et al. | |
| 2010/0172120 | A1 | 7/2010 | Wegh et al. | |
| 2011/0141725 | A1 | 6/2011 | Brusilovsky | |
| 2014/0321115 | A1 | 10/2014 | Goldstein et al. | |
| 2016/0312965 | A1* | 10/2016 | Hikmet | F21V 7/28 |

FOREIGN PATENT DOCUMENTS

| | | | |
|---|---|---|---|
| EP | 2447747 | A1 | 5/2012 |
| EP | 2778506 | A1 | 9/2014 |
| EP | 2902696 | A1 | 8/2015 |
| EP | 2935980 | B1 | 10/2015 |
| WO | 2012120332 | A1 | 9/2012 |
| WO | 2014191251 | A1 | 12/2014 |
| WO | 2015092695 | A1 | 6/2015 |
| WO | 2015092696 | A1 | 6/2015 |
| WO | 2016012574 | A1 | 1/2016 |

* cited by examiner

LIGHT EMITTING MODULE

CROSS-REFERENCE TO PRIOR APPLICATIONS

This application is the U.S. National Phase application under 35 U.S.C. § 371 of International Application No. PCT/EP2018/069412, filed on Jul. 17, 2018, which claims the benefit of European Patent Application No. 17182652.2, filed on Jul. 21, 2017. These applications are hereby incorporated by reference herein.

FIELD OF THE INVENTION

The present invention relates to a light emitting module which comprises a light mixing chamber and least one light emitting diode. The present invention further relates to a lamp and a luminaire comprising such a light emitting module. The present invention further relates to a lighting system comprising at least two light emitting modules and/or at least two lamps or luminaires.

BACKGROUND OF THE INVENTION

The field of light emitting modules includes a large variety of different light emitting modules regarding use of light sources, construction, optical characteristics, etc. These light emitting modules are used in many lighting applications such as office and consumer luminaires.

Important characteristics for many applications of light emitting modules are that they shall be arranged to provide uniform illumination. Another important aspect of light emitting modules is the increasing need of providing energy efficient light emitting modules. One example of light emitting modules being energy efficient is light emitting modules being based on light emitting diodes, LEDs.

In order to obtain uniform light various strategies have been adopted. One of the strategies is based on placing large number of LEDs at the bottom of a mixing chamber in combination with a diffuser. However, LEDs are point sources and hence there is a problem of producing LED based light emitting modules providing uniform illumination. Placing LEDs at the bottom surface can lead to visibility of individual LEDs, which provides a so-called undesired spottiness appearance. Furthermore placing large number of LEDs at the bottom of a mixing chamber is costly.

EP2935980B1 discloses an alternative flat light emitting module having LEDs mounted at the inner side of the circumferential wall, typically having a dimensional ratio of width W versus height H of about 8. The known device has as a disadvantage that light is not emitted from the sides. Yet, in many applications it is desired that the light exit window of the light emitting modules provides uniform illumination and that also light is emitted from the sides of these luminaires.

SUMMARY OF THE INVENTION

It is an object of the present invention to provide a light emitting module that provides relatively efficient and uniform illumination from both the top surface and from the side surface.

The present invention discloses a light emitting module in accordance with the independent claim 1. Preferred embodiments are defined by the dependent claims.

According to a first aspect of the invention, a light emitting module is provided which comprises a mixing chamber. The light mixing chamber comprises a base, at least one partly light transmissive side wall, an at least partly light transmissive-semi-reflective light exit window, a carrier, and at least one light emitting diode. The base has a reflective inner surface. The at least one partly light transmissive side wall extends from the base towards the at least partly light transmissive, semi-reflective light exit window which is arranged opposite to the base. The carrier carries at least one light emitting diode and is positioned at a distance from a nearest portion of the at least one partly light transmissive side wall. The at least one light emitting diode is arranged to emit source light in a main direction different from 90 degrees with respect to the semi-reflective light exit window and in the main direction away from the nearest portion of the at least one partly light transmissive side wall to enable subsequent mixing of the source light within the mixing chamber to generate mixed light. The semi-reflective light exit window and the at least one partly light transmissive side wall are arranged to couple out source light and mixed light as emitted light. The mixing chamber has an inner mixing chamber width in the direction along the base between the nearest portion of the at least one partly light transmissive side wall and an opposite portion of the at least one partly light transmissive side wall which is positioned opposite to the nearest portion of the at least one partly light transmissive side wall. An inner mixing chamber height spaces the base and the semi-reflective light exit window. The inner mixing chamber width and the inner mixing chamber height have an aspect ratio in the range of 4 to 15. The semi-reflective light exit window has a reflectivity in the range from 30 to 80% for source light and mixed light. The distance from the at least one light emitting diode to the nearest portion of the at least one partly light transmissive side wall is in the range from 5 to 30% of the inner mixing chamber width.

Hence the invention provides a light emitting module that is able to provide uniform illumination from both the top surface and from the side surface. The reason is that instead of mounting LEDs at the inner side of the side wall, LEDs are mounted on a carrier and positioned at a particular distance from a partly light transmissive side wall. In order for the light emitting module to achieve relatively efficient and uniform illumination from both the top surface and from the side surface, various useful parameters of the mixing chamber needs to be considered. An useful parameter of the mixing chamber in order for the light emitting module to achieve uniform illumination from both the top surface and from the side surface is the orientation of the LEDs. The inventors have found that by arranging the LEDs such that the LEDs emit source light in a main direction different from 90 degrees with respect to the semi-reflective light exit window and in the main direction away from the nearest portion of the at least one partly light transmissive side wall improved mixing of the emitted source light within the mixing chamber is obtained and thus a light emitting module which provides improved uniform illumination from both the top surface and from the side surface is obtained. Another useful parameter of the mixing chamber in order for the light emitting module to achieve uniform illumination from both the top surface and from the side surface is the aspect ratio between the width and the height of the mixing chamber. The inventors have found that by having an aspect ratio of the inner mixing chamber width and the inner mixing chamber height of the mixing chamber in the range of 4 to 15 a light emitting module which provides improved uniform illumination from both the top surface and from the side surface are obtained. Another useful parameter of the mixing chamber in order for the light emitting module to achieve uniform illumination from both the top surface and from the side surface is the reflectivity of the semi-reflective light exit window. The inventors have found that by having a reflectivity of the semi-reflective light exit window in the range from 30 to 80% for source light and mixed light improved mixing of the source light and mixed light within the mixing chamber is obtained and thus a light emitting module which provides improved uniform illumination from both the top surface and from the side surface are obtained. Another useful parameter of the mixing chamber in order for the light emitting module to achieve uniform illumination from both the top surface and from the side surface is the distance from the at least one light emitting diode to the nearest portion of the at least one partly light transmissive side wall and the distance between the at least one light emitting diode to the opposite portion of the at least one partly light transmissive side wall. The inventors have found that by having a distance from the at least one light emitting diode to the nearest portion of the at least one light transmissive side wall is in the range from 5 to 30% of the inner mixing chamber width improved mixing of the emitted source light and mixed light within the mixing chamber is obtained and thus a light emitting module which provides improved uniform illumination from both the top surface and from the side surface are obtained. The inventors have found that by using previous useful parameters a light emitting module which provides an uniform illumination from both the top surface and from the side surface may be achieved, which will be explained in more detail below.

The light emitting module as, for example, disclosed in EP2935980B1, is unable to produce uniform illumination from the top surface and uniform illumination from the side surface. Even if the circumferential wall would be light transmissive, such as for example translucent, it cannot provide uniform illumination from the top surface and uniform illumination from the side surface. The reason is that the LEDs mounted at the inner side of the circumferential wall will block the light at the position of the LEDs which results in undesired dark areas.

In an embodiment, the distance from the at least one light emitting diode to the nearest portion of the at least one partly light transmissive side wall is preferably in the range from 6 to 23% of the inner mixing chamber width. The obtained effect is to further improve the uniform illumination from the top surface and from the side surface. The reason is improved light mixing.

In an embodiment, the distance from the at least one light emitting diode to the nearest portion of the at least one partly light transmissive side wall is preferably in the range from 7 to 17% of the inner mixing chamber width. The obtained effect is to further improve the uniform illumination from the top surface and from the side surface. The reason is improved light mixing.

In an embodiment, the reflective inner surface may be a diffusely reflective inner surface. The diffusely reflective inner surface may be made by using highly reflective particles such as for example $TiO_2$, $BaSO_4$ and/or $Al_2O_3$ in a polymer matrix material such as a plastic e.g. using silicone, poly metha methylacrylate (PMMA), polycarbonate (PC), polytherephthalate (PET). The reflective inner surface may also be a specularly reflective inner surface. The specularly reflective inner surface may be made by evaporating aluminium or silver on top of a substrate such as for example a plastic substrate e.g. made from silicone, poly metha methylacrylate (PMMA), polycarbonate (PC), polytherephthalate (PET).

In an embodiment, the reflectivity of the reflective inner surface of the base is preferably at least 80%. More preferably, the reflectivity of the reflective inner surface of the base is at least 85%. Most preferably, the reflectivity of the reflective inner surface of the base is at least 88%. The obtained effect is improved efficiency. The reason is that less light is lost due to absorption, especially in case of multiple reflections of light in the mixing chamber.

In an embodiment, the carrier carries at least 5 light emitting diodes such as for example 10 light emitting diodes. The light emitting diodes may be phosphor converted LEDs. The light emitting diodes may be white LEDs. The light emitting diodes may emit white light of the same color temperature. The light emitting diodes may be direct emitting LEDs. The light emitting diodes may emit colored light of the same color point. The light emitting diodes may also be a combinations of phosphor converted and direct emitting light emitting diodes.

In an embodiment, the carrier has a carrier height transverse to the semi-reflective light exit window. The obtained effect is improved ease of assembly. The reason is that at least one light emitting diode can be easily attached to the carrier and/or the carrier carrying the at least one light emitting diode can be easily bended according to this configuration. The carrier may, for example, be a rigid circuit board or a flexible circuit board. The flexible circuit board, such as for example a flat flexible circuit board, may be bended such that the carrier extends along a carrier height transverse to the semi-reflective light exit window.

In an embodiment, the carrier comprises a carrier length which is at least 5 times the carrier height. More preferably, the carrier comprises a carrier length which is at least 8 times the carrier height. Most preferably, the carrier comprises a carrier length which is at least 10 times the carrier height. The obtained effect is to further improve the uniform illumination from the top surface and from the side surface. The reason is that the optical path length from the at least one light emitting diode to the inner side of the at least one partly light transmissive side wall is increased and thus light emitted from the at least one light emitting diode can be better spread in the mixing chamber.

In an embodiment, the carrier is ring shaped in a direction along the semi-reflective light exit window. The ring shape may have a cross-section of a circle, oval, hexagon, square or rectangle. The obtained effect is that it improves the ease of assembly. The reason is that a flexible carrier may be used which can be connected at both ends and fixed to the base.

In an embodiment, the carrier height is less than 0.6 times the inner mixing chamber height. More preferably, the carrier height is less than 0.5 times the inner mixing chamber height. Most preferably, the carrier height is less than 0.4 times the inner mixing chamber height. The obtained effect is that it further improves the uniform illumination from both the top surface and from the side surface. The reason is that less light emitted from the at least one light emitting diode is blocked by the carrier.

In an embodiment, the at least one light emitting diode is positioned closer to the base than to the semi-reflective light exit window. The obtained effect is that it further improves the uniform illumination from both the top surface and from the side surface. The reason is that the optical path length from the at least one light emitting diode to the semi-reflective light exit window is increased and thus light emitted from the at least one light emitting diode can be better spread in the mixing chamber.

In an embodiment, the at least one light emitting diode comprises a collimator which is arranged to collimate the light in the direction to the opposite portion. The obtained effect is that uniform illumination from both the top surface and from the side surface is further improved. The reason is that realtively more light emitted from the at least one light emitting diode reaches the inner side of the at least one side wall. The collimator may be a reflector or a total internal reflection (TIR) optical element. The collimator may provide assymetric collimation such that light in the direction perpendicular the base is collimated more than light in the direction along the base.

In an embodiment, the carrier is transmissive for visible light. The obtained effect is that it further improves the uniform illumination from both the top surface and from the side surface. The reason is that less light emitted from the at least one light emitting diode is blocked by the carrier.

In an embodiment, the carrier is translucent and/or comprising through holes in the carrier at a portion of the carrier adjacent to the at least one light emitting diode. The obtained effect is that it further improves the uniform illumination from both the top surface and from the side surface. The reason is that less light emitted from the at least one light emitting diode is blocked by the carrier.

In an embodiment, the shape of the cross section of the carrier in a direction along the semi-reflective light exit window resembles a shape of a cross-section of the at least one partly light transmissive side wall. Preferably, the carrier is centered in the mixing chamber and a plurality of light emitting diodes is used. The obtained effect is that it further improves the uniform illumination from both the top surface and from the side surface. The reason is that the distance from each light emitting diode to the nearest portion of the at least one partly light transmissive side wall is the same and the distance from each light emitting diode to the opposite portion of the at least one side wall is the same.

In an embodiment, the at least one partly light transmissive side wall is semi reflective, semi refractive or semi diffractive. The obtained effect is that it further improves the uniform illumination from both the top surface and from the side surface. The reason is that part of the light impinging on the at least one side wall is redirected such as for example reflected and thus improved mixing of light is obtained.

In an embodiment, the reflectivity of the at least one partly light transmissive side wall is less than the reflectivity of the semi-reflective light exit window. The obtained effect is that it further improves the uniform illumination from both the top surface and from the side surface. The reason is that relatively more light is reflected by semi-reflective light exit window compared to the at least one partly light transmissive side wall.

In an embodiment, the at least one light emitting diode (105) comprises a plurality of light emitting diodes. The light emitting diodes (105) are arranged at a different positions along the carrier length (L1) of the carrier (107). The pitch (P1) between neighboring light emitting diodes (105) is smaller than the inner mixing chamber height (H1). The obtained effect is that is that it further improves the uniform illumination from both the top surface and from the side surface. The reason is that the optical path length between the light emitting diodes is reduced and thus light emitted from the at least one light emitting diode can be better spread in the mixing chamber.

The LEDs may be evenly distributed over the length of the carrier. The light emitting module may be essentially rotationally symmetric about an axis A perpendicular to the exit window (y-direction). The LEDs preferably have a main light emission direction radially inward.

The present invention discloses a lamp or luminaire in accordance with claim 14.

In an embodiment, a lamp or luminaire comprises the light emitting module and is provided with at least one driver. The lamp may comprise a base which may be connected to a socket of a luminaire. The driver may be electrically connected to the base and the light source. The driver may comprise a driver circuit. The driver circuit converts the electrical output of the luminaire, i.e. the electrical input for the driver, to an electrical output of the driver that is matched to electrical characteristics of the light source such as an LED or LEDs. Typically the electrical input of the driver is an alternating current at a high voltage such as the mains voltage which is converted by the driver circuit into a direct current at a low voltage. The obtained effect is that the electrical output of the driver is safe to touch during connection of the light unit to the electrical connection of the carrier. The electrical output of the carrier is not safe to touch when connecting the light unit to the electrical connection of the carrier in case the light unit comprises the driver. The electrical energy that flows through a portion of the body will cause a shock and may result in injury or devastating damage.

The present invention discloses a lighting system in accordance with claim 15.

In an embodiment, a lighting system comprises at least two light emitting modules and/or at least two lamps or luminaires.

BRIEF DESCRIPTION OF THE DRAWINGS

Embodiments of the invention will now be described, by way of example only, with reference to the accompanying schematic drawings in which corresponding reference symbols indicate corresponding parts, and in which:

FIG. 1*a* schematically depicts a side-view of the lighting emitting module along the length direction in the XY plane according to an embodiment of the present invention;

FIG. 1*b* schematically depicts a cross-section of the lighting emitting module along the length direction in the XY plane according to an embodiment of the present invention;

FIG. 1*c* schematically depicts a top-view of the lighting emitting module along the length direction in the XZ plane according to an embodiment of the present invention;

FIG. 1*d* schematically depicts a cross-section of the lighting emitting module along the length direction in the XZ plane according to an embodiment of the present invention;

The schematic drawings are not necessarily on scale.

The same features having the same function in different figures are referred to the same references.

DETAILED DESCRIPTION OF THE EMBODIMENTS

FIG. 1*a*-1*d* schematically depicts a light emitting module according (100) to an embodiment of the present invention.

Figure 1A:
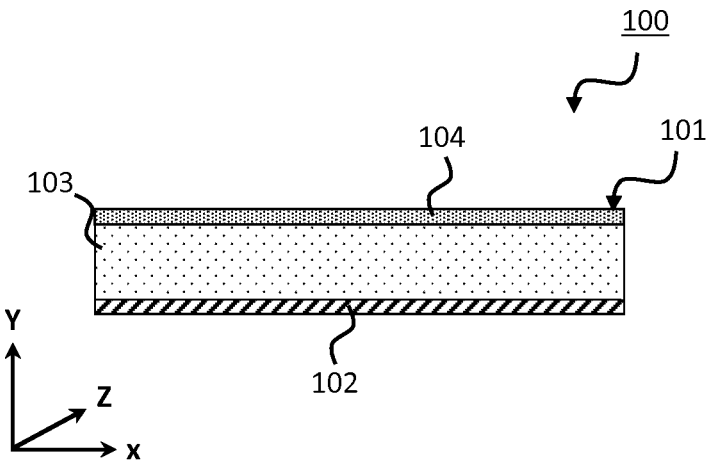
FIGS. 1*a*-1*d* schematically depicts a light emitting module according to an embodiment of the present invention.
Figure 1B:
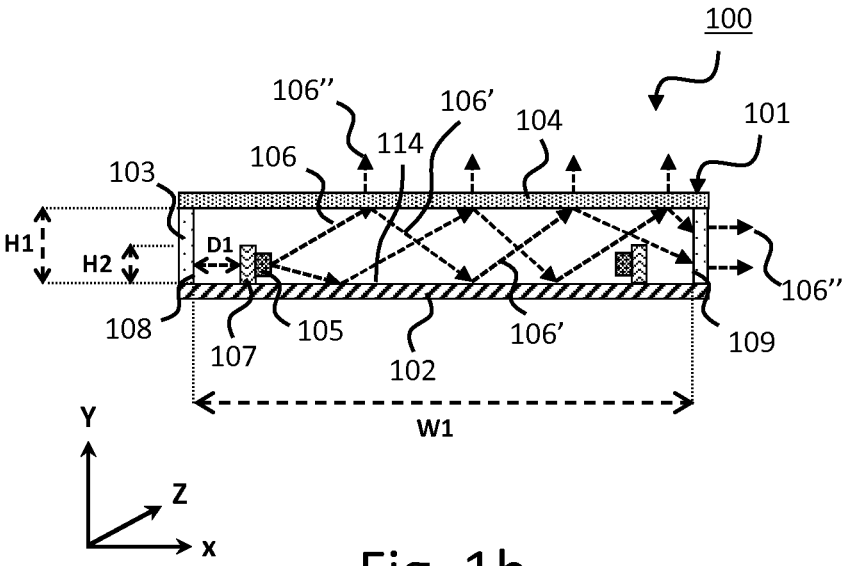
Figure 1C:
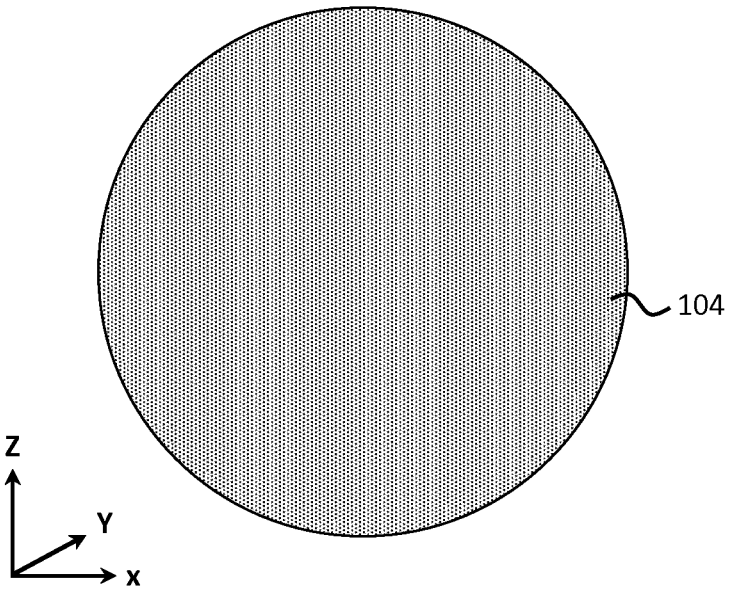
Figure 1D:
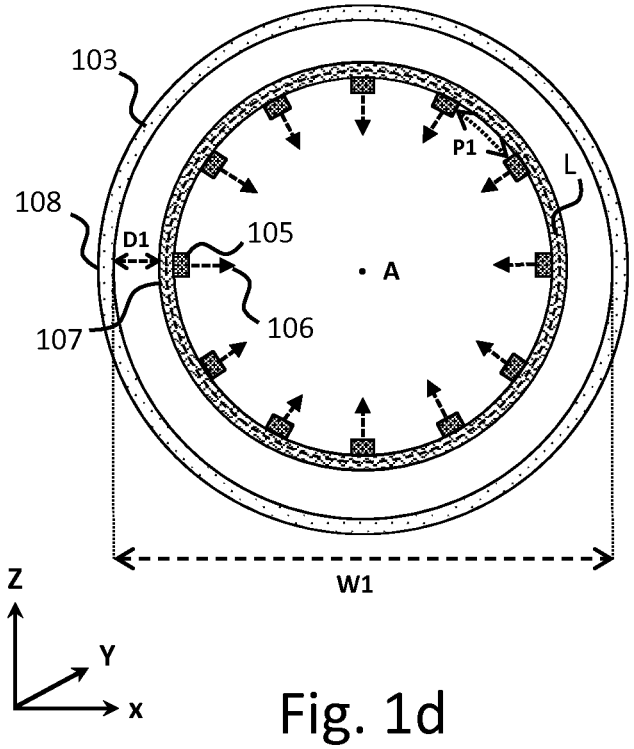

FIG. 1*a* schematically depicts a side-view of the lighting emitting module (100) along the length direction in the XY plane according to an embodiment of the present invention. FIG. 1*b* schematically depicts a cross-section of the lighting emitting module (100) along the length direction in the XY plane according to an embodiment of the present invention. FIG. 1*c* schematically depicts a top-view of the lighting emitting module (100) along the length direction in the XZ plane according to an embodiment of the present invention. FIG. 1*d* schematically depicts a cross-section of the lighting emitting module (100) along the length direction in the XZ plane according to an embodiment of the present invention.

As depicted in FIG. 1*a*-1*d*, the light emitting module (100) comprises a mixing chamber (101). The mixing chamber (101) comprises a base (102), at least one side wall (103), a semi-reflective light exit window (104), a carrier (107), and at least one light emitting diode (105). The base (102) has a reflective inner surface (114). The at least one partly light transmissive side wall (103) extends from the base (102) towards the at least partly light transmissive, semi-reflective light exit window (104) which is arranged opposite to the base (102). The carrier (107) varies at least one light emitting diode (105) and is positioned at a distance (D1) from a nearest portion (108) of the at least one partly light transmissive side wall (103). The at least one light emitting diode (105) is arranged to emit source light (106) in a main direction different from 90 degrees with respect to the semi-reflective light exit window (104) and in the main direction away from the nearest portion (108) of the at least one partly light transmissive side wall (103) to enable subsequent mixing of the source light (106) within the mixing chamber (101) to generate mixed light (106'). The semi-reflective light exit window (104) and the at least one partly light transmissive side wall (103) are arranged for coupling out source light (106) and mixed light (106') as emitted light (106"). The mixing chamber (101) has an inner mixing chamber width (W1) in the direction along the base (102) between the nearest portion (108) of the at least one partly light transmissive side wall (103) and an opposite portion (109) of the at least one partly light transmissive side wall (103) which is positioned opposite to the nearest portion (108) of the at least one partly light transmissive side wall (103). An inner mixing chamber height (H1) spaces the base (102) and the semi-reflective light exit window (104). The inner mixing chamber width (W1) and the inner mixing chamber height (H1) have an aspect ratio in the range of 4 to 15. The semi-reflective light exit window (104) has a reflectivity in the range from 30 to 80% for source light (106) and mixed light (106'). The distance (D1) from the at least one light emitting diode (105) to the nearest portion (108) of the at least one partly light transmissive side wall (103) is in the range from 5 to 30% of the inner mixing chamber width (W1).

As depicted in FIG. 1*b*, the carrier (107) has a carrier height (H2) transverse to the semi-reflective light exit window (104).

As depicted in FIG. 1*b*, the carrier (107) may be positioned on the base (102).

As depicted in FIGS. 1*b* and 1*d*, the carrier (107) may have a carrier length (L1) which is at least 5 times the carrier height (H2).

As depicted in FIG. 1*d*, the carrier (107) may be ring shaped in a direction along the semi-reflective light exit window (104). Preferably the ring shape has a cross-section of a circle, oval, hexagon, square or rectangle.

As depicted in FIG. 1*b*, the carrier height (H2) may be less than 0.6 times the inner mixing chamber height (H1).

As depicted in FIG. 1*b*, the at least one light emitting diode (105) may be positioned closer to the base (102) than to the semi-reflective light exit window (104).

As depicted in FIG. 1*d*, the shape of the cross section of the carrier (107) in a direction along the semi-reflective light exit window (104) resembles a shape of a cross-section of the at least one partly light transmissive side wall (103).

As depicted in FIG. 1*d*, the at least one side wall (103) may be semi reflective, semi refractive or semi diffractive.

The reflectivity of the at least one partly light transmissive side wall (103) is less than the reflectivity of the semi-reflective light exit window (104).

As depicted in FIG. 1*d*, the at least one light emitting diode (105) comprises a plurality of light emitting diodes, wherein the light emitting diodes (105) are arranged at a different positions along the carrier length (L1) of the carrier (107). The pitch (P1) between neighboring light emitting diodes (105) is smaller than the inner mixing chamber height (H1).

Figure 2A:
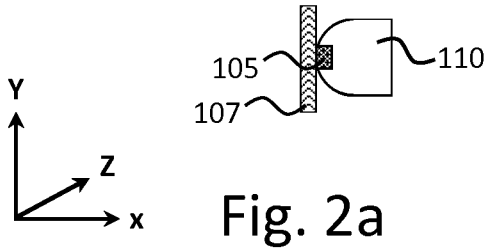
FIGS. 2*a*-2*c* schematically depict a cross-sections of the carrier along the length direction in the XY plane according to an embodiment of the present invention.
Figure 2B:
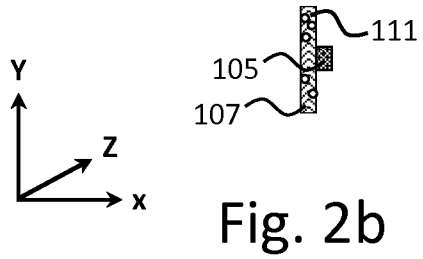
Figure 2C:
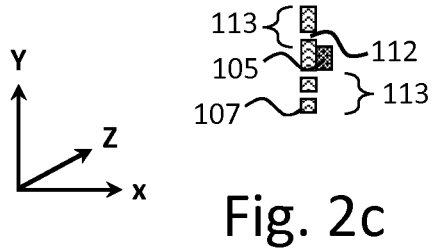

FIGS. 2*a*-2*c* schematically depict a cross-sections of the carrier along the length direction in the XY plane according to an embodiment of the present invention. As depicted in FIG. 2*a*, the at least one light emitting diode (105) may comprise a collimator (110) which is arranged to collimate the light (106) in the direction to the opposite portion (109).

As depicted in FIG. 2*a*, the carrier (107) may be transmissive for visible light.

As depicted in FIG. 2*b*, the carrier (107) may translucent (111).

As depicted in FIG. 2*c*, the carrier (107) may comprise through holes (112) in the carrier at a portion (113) of the carrier (107) adjacent to the at least one light emitting diode (105).

Figure 3:
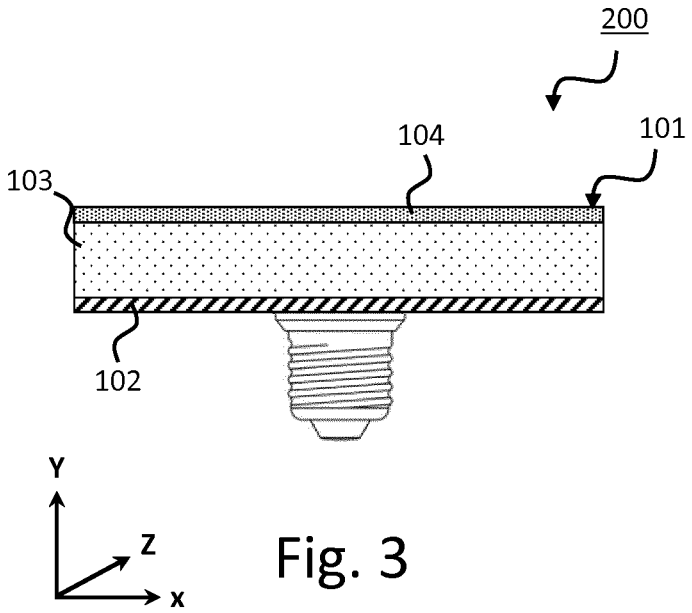
FIG. 3 schematically depicts a side view of the lamp along the length direction in the XY plane according to an embodiment of the present invention.

FIG. 3 schematically depicts a side view of the lamp along the length direction in the XY plane according to an embodiment of the present invention. As depicted in FIG. 3, a lamp (200) may comprise the light emitting module (100) provided with at least one driver (not shown).

Figure 4:
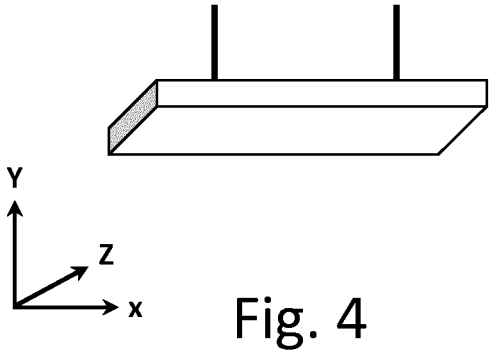
FIG. 4 schematically depicts a side view of the luminaire along the length direction in the XY plane according to an embodiment of the present invention.

FIG. 4 schematically depicts a side view of the luminaire along the length direction in the XY plane according to an embodiment of the present invention. As depicted in FIG. 4, a luminaire (300) may comprise the light emitting module (100) provided with at least one driver (not shown).

A lighting system may comprise at least two light emitting modules as depicted in FIG. 1 and/or at least two lamps as depicted in FIG. 3 or luminaires as depicted in FIG. 4.

The light emitting module (100) may be configured to provide white light. The term white light herein, is known to the person skilled in the art and relates to white light having a correlated color temperature (CCT) between about 2.000 K and 20.000 K. In an embodiment the CCT is between 2.500 K and 10.000K. Usually, for general lighting, the CCT is in the range of about 2700K to 6500K. Preferably, it relates to white light having a color point within about 15, 10 or 5 SDCM (standard deviation of color matching) from the BBL (black body locus). Preferably, it relates to white light having a color rendering index (CRI) of at least 70 to 75, for general lighting at least 80 to 85.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise"

includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A light emitting module comprising a light mixing chamber comprising:

a base having a reflective inner surface, at least one partly light transmissive side wall extending from the base towards an at least partly light transmissive, semi-reflective light exit window arranged opposite to the base, and a carrier for carrying at least one light emitting diode and being positioned at a distance (D1) from a nearest portion of the at least one partly light transmissive side wall, wherein the at least one light emitting diode is arranged to emit source light in a main direction different from 90 degrees with respect to the semi-reflective light exit window and in the main direction away from the nearest portion of the at least one partly light transmissive side wall for enabling subsequent mixing of the source light within the mixing chamber to generate mixed light, and wherein the semi-reflective light exit window and the at least one partly light transmissive side wall are arranged for coupling out source light and mixed light as emitted light, wherein the mixing chamber has an inner mixing chamber width (W1) in the direction along the base between the nearest portion of the at least one partly light transmissive side wall and an opposite portion of the at least one partly light transmissive side wall being positioned opposite to the nearest portion of the at least one partly light transmissive side wall, and an inner mixing chamber height (H1) spacing the base and the semi-reflective light exit window, wherein a ratio of the inner mixing chamber width (W1) to the inner mixing chamber height (H1) is in the range of 4:1 to 15:1, wherein the semi-reflective light exit window has a reflectivity in the range from 30 to 80% for source light and mixed light, and wherein the distance (D1) from said carrier to the nearest portion of the at least one partly light transmissive side wall is in the range from 5 to 30% of the inner mixing chamber width (W1).

2. A light emitting module according to claim 1, wherein the carrier has a carrier height (H2) transverse to the semi-reflective light exit window.

3. A light emitting module according to claim 2, wherein the carrier comprises a carrier length (L1), the carrier length (L1) being at least 5 times the carrier height (H2).

4. A light emitting module according to claim 1, wherein the carrier is ring shaped in a direction along the semi-reflective light exit window, and preferably the ring shape has a cross-section of a circle, oval, hexagon, square or rectangle.

5. A light emitting module according to claim 2, wherein the carrier height (H2) is less than 0.6 times the inner mixing chamber height (H1).

6. A light emitting module according to claim 1, wherein the at least one light emitting diode is positioned closer to the base than to the semi-reflective light exit window.

7. A light emitting module according to claim 1, wherein the at least one light emitting diode comprises a collimator arranged to collimate the light in the direction to the opposite portion.

8. A light emitting module according to claim 1, wherein the carrier is transmissive for visible light.

9. A light emitting module according to claim 8, wherein the carrier is translucent and/or comprises through holes in the carrier at a portion of the carrier adjacent to the at least one light emitting diode.

10. A light emitting module according to claim 1, wherein the shape of the cross section of the carrier in a direction along the semi-reflective light exit window resembles a shape of a cross-section of the at least one partly light transmissive side wall.

11. A light emitting module according to claim 1, wherein the at least one partly light transmissive side wall is semi reflective, semi refractive or semi diffractive.

12. A light emitting module according to claim 1, wherein the reflectivity of the at least one partly light transmissive side wall is less than the reflectivity of the semi-reflective light exit window.

13. A light emitting module according to claim 1, wherein the at least one light emitting diode comprises a plurality of light emitting diodes, wherein the light emitting diodes are arranged at a different positions along the carrier length (L1) of the carrier, and wherein the pitch (P1) between neighboring light emitting diodes is smaller than the inner mixing chamber height (H1).

14. A lamp or luminaire comprising the light emitting module as claimed according to claim 1 provided with at least one driver.

15. A lighting system comprising at least two light emitting modules as claimed in claim 1.

* * * * *